United States Patent [19]

Lowe

[11] Patent Number: 4,645,149

[45] Date of Patent: Feb. 24, 1987

[54] CAMMING DEVICE FOR CLIMBERS

[75] Inventor: Greg E. Lowe, Boulder, Colo.

[73] Assignee: Lowe Alpine Systems, Inc., Lafayette, Colo.

[21] Appl. No.: 772,623

[22] Filed: Sep. 4, 1985

[51] Int. Cl.[4] ..... A47G 29/00

[52] U.S. Cl. ..... 248/1

[58] Field of Search ..... 248/1, 317, 344; 294/94, 95

[56] References Cited

U.S. PATENT DOCUMENTS

| | | | |
|---|---|---|---|
| 3,877,679 | 4/1975 | Lowe | 248/1 |
| 4,184,657 | 1/1980 | Jardine | 248/1 |
| 4,565,342 | 1/1986 | Grow | 248/1 |

FOREIGN PATENT DOCUMENTS 8896 of 1901 United Kingdom .

*Primary Examiner*—Ramon O. Ramirez
*Attorney, Agent, or Firm*—Robert E. Harris

[57] ABSTRACT

A camming, or wedging, device is disclosed that is particularly useful in climbing a severely sloping surface, such as, for example, the side of a rock or mountain formation having natural or man-made openings therein and into which the camming device may be releasably anchored to facilitate climbing. The camming device includes a support arm having a plurality of interrelated cam members pivotally mounted thereon at one end, and a centrally mounted cam actuator connected with the cam members to control movement of the cam members from an extended (open) position to a withdrawn (closed) position. Each cam member has a serrated arcuate cam surface that is positioned adjacent to the support arm when the cam member is pivoted to the withdrawn position by the cam actuator, and is biased so that the cam surfaces are urged away from the support arm toward the extended position when not being acted upon by the cam actuator, with the cam surfaces of the cam members extending different distances from the support arm when in the extended position to thereby allow firm anchoring of the camming device over a broad size range of openings. The camming device also includes a strap engaging member on the central portion of the support arm, and a rope engaging member on the end portion opposite the cam members for enabling concurrent or independent use of a strap and a rope during climbing.

19 Claims, 18 Drawing Figures

CAMMING DEVICE FOR CLIMBERS

FIELD OF THE INVENTION

This invention relates to a camming device and, more particularly, relates to an expandable camming device that is particularly useful for climbing.

BACKGROUND OF THE INVENTION

Many camming, or wedging, devices have heretofore been suggested and/or utilized for many diverse purposes, and some such devices have been heretofore suggested and/or utilized in connection with climbing of rocks and/or mountains.

In addition, camming devices have heretofore been suggested and/or utilized that include cam members having serrated faces (see, for example, British Pat. No. 8896) and/or have been spring mounted (see, for example U.S. Pat. Nos. 4,184,657 and 3,877,679).

Prior camming devices have, however, required relatively cumbersome structure and/or have been adapted for use in either large openings or in small openings, but not in both, due to imposed structural limitations presented for the desired use, and/or have not been found to be satisfactorily usable in at least some of the openings normally expected to be encountered. In addition, at least some prior camming devices have not been easily and quickly repairable due to construction, such as requiring springs wound about the center spindle such that such springs cannot be quickly replaced.

SUMMARY OF THE INVENTION

This invention provides an improved camming device that is particularly useful for climbing. The camming device includes a plurality of interrelated cam members pivotally mounted on a support arm to enable satisfactory use of the device to achieve firm anchoring over an extended size range of openings with both insertion of the device into relatively small openings and insertion of the device into relatively large openings being readily accommodated, with the support arm being capable of connection to a rope normally utilized in climbing as well as being usable independently of, or concurrently with, such a rope.

It is therefore an object of this invention to provide an improved camming device.

It is another object of this invention to provide an improved camming device that is particularly well suited for climbing.

It is another object of this invention to provide an improved camming device having a plurality of cam members.

It is still another object of this invention to provide an improved camming device which is usable over a broad size range of openings.

It is still another object of this invention to provide an improved camming device that is particularly useful for climbing rock and/or mountain formations.

It is still another object of this invention to provide an improved camming device for climbing which can be easily and quickly released from an opening.

With these and other objects in view, which will become apparent to one skilled in the art as the description proceeds, this invention resides in the novel construction, combination, and arrangement of parts substantially as hereinafter described, and more particularly defined by the appended claims, it being understood that changes in the precise embodiments of the herein disclosed invention are meant to be included as come within the scope of the claims.

BRIEF DESCRIPTION OF THE DRAWINGS

The accompanying drawings illustrate complete embodiments of the invention according to the best mode so far devised for the practical application of the principles thereof, and in which.

DESCRIPTION OF THE INVENTION

Figures 1, 2, 3:
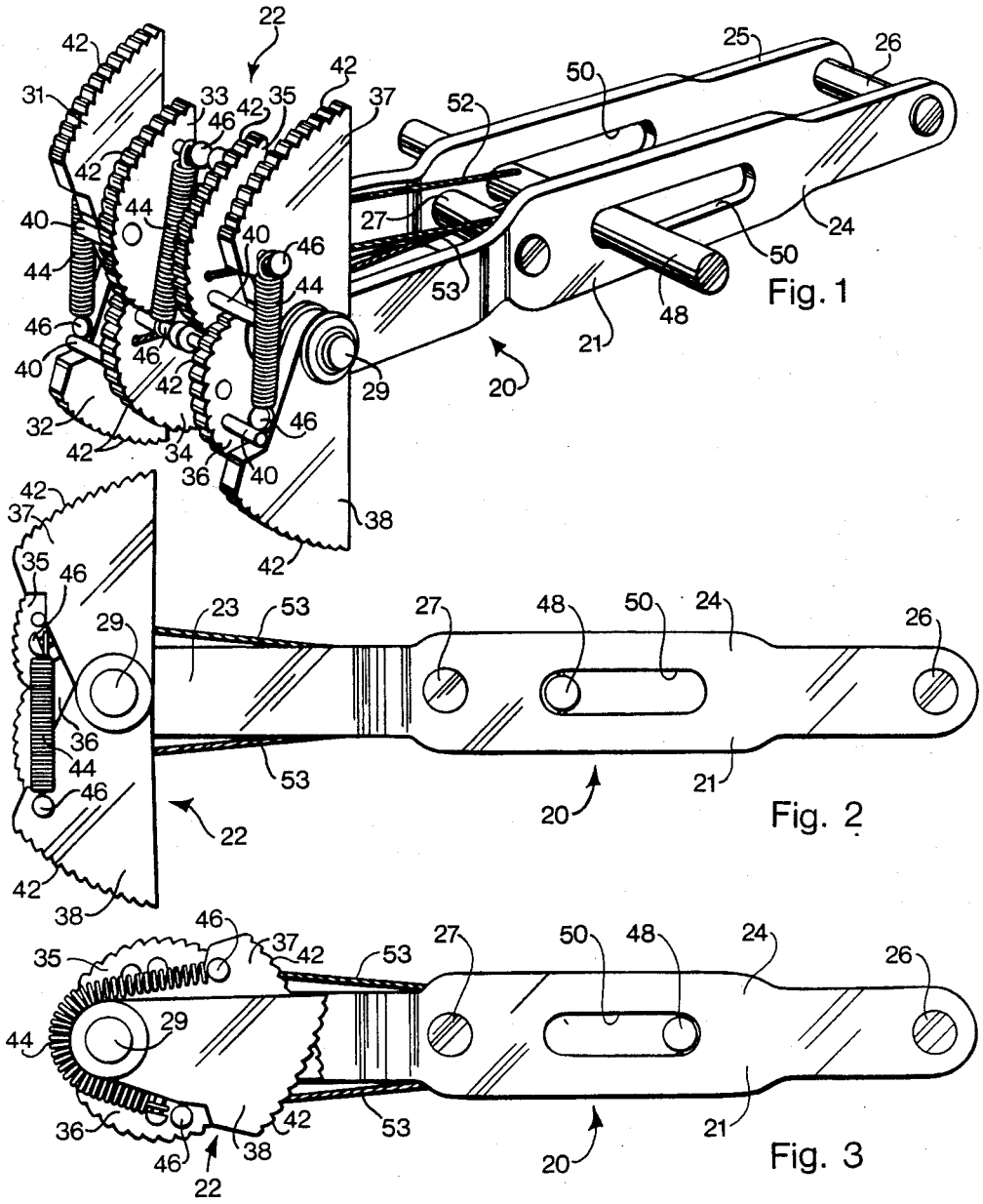
FIG. 1 is a perspective view of the now preferred embodiment of the camming device of this invention illustrating the cam members in the fully extended position.
FIG. 2 is a side elevation view of the camming device shown in FIG. 1.
FIG. 3 is a side elevation view of the camming device shown in FIGS. 1 and 2, but illustrating the cam members in the fully withdrawn position.
Figure 4:
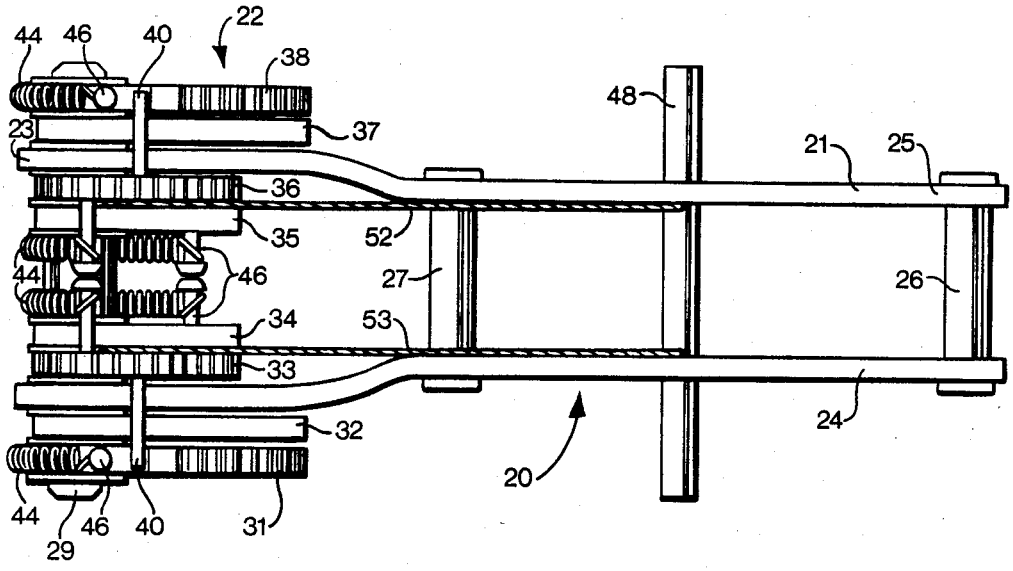
FIG. 4 is a bottom elevation view of the camming device shown in FIG. 3.

Camming, or wedging, device 20 is shown in FIGS. 1 through 4, to include a support arm 21 having camming structure 22 mounted at one end 23 thereof. Support arm 21 includes, as best shown in FIGS. 1 and 4, a pair of spaced bars, or struts, 24 and 25, the spacing between which is established by spacers 26 and 27.

Spacer 26 provides a snap link or rope receiving element, and may have a rope protective plastic coating (not shown) placed thereon (with such a coating also preferably being placed on the adjacent portion of bars 24 and 25). Spacer 27 provides an ancillary receiving element for receiving a rope or strap for concurrent or independent use in conjunction with a rope received at element 26, with element 27 having been found to be particularly useful for fastening a short length of strap thereto to reduce leverage on the device while climbing.

Bars 24 and 25 diverge outwardly from spacer 27 toward end 23 of the support arm to increase the spacing between the bars at end 23 to receive camming structure 22 thereat. Camming structure 22 includes a pivot, or mounting, axle rod 29 received through apertures at end 23 of bars 24 and 25.

A plurality of cam members (numbered 31 through 38 as shown in FIGS. 1 and 4) are mounted on rod 29 in spaced relationship with respect to one another (as by washers therebetween, for example) so that each cam member is freely pivotable with respect to the rod and with respect to one another except as limited by pins 40 extending from smaller cam members 33 through 36, which pins engage the adjacent larger cam member 31, 32, 37 and 38 to provide an extended position limit and to cause movement of the larger cam members to the withdrawn position when the smaller cam members are moved to the withdrawn position, as is brought out more fully hereinafter.

Each of cam members 31 through 38 has a serrated arcuate cam surface 42. As shown in FIGS. 1 and 2 when the cam members are in the extended, or open, position, the cam surfaces 42 extend outwardly from the support arm toward engagement with the walls of an opening into which the camming device is then to be anchored. The cam members, or elements, are biased toward the extended position by springs 44 extending between spring retainers 46 on the cam members. As shown, springs 44 are connected between adjacent ones of cam member pairs (i.e., between pairs of cam members 31 and 32, 33 and 34, 35 and 36, and 37 and 38) with each cam member of each pair extending outwardly at opposite sides from the support arm.

Cam actuator rod 48 is mounted in slot 50 in each of the support bars 24 and 25 so that the rod may be moved axially along the slots in forwardly and rearwardly directions. Cables 52 and 53 extend between arcuate rod 48 and smaller cam members 33 and 34 and 35 and 36, respectively. Actuator rod 48 is normally biased to the front of slots 50, as indicated in FIGS. 1 and 2 because of the bias established on the cam members due to springs 44.

As best shown in FIG. 1, each pair of cam members (i.e., pairs 31 and 32, 33 and 34, 35 and 36, and 37 and 38) extend outwardly in opposite directions from rod 29 and support arm 21 when the cam members are in the fully extended positions, and the cam members of each pair partially overlap one another adjacent to the support bar when the cam members are in the fully withdrawn position (as shown in FIG. 3).

When fully withdrawn, all of the cam surfaces are adjacent to the support arm and do not extend appreciably outwardly from the support arm. In the withdrawn position, it is therefore possible to insert the camming device of this invention in an opening not appreciably greater in size than that of the smaller cam members 33, 34, 35 and 36 and still achieve a firm anchor thereat. As also shown best in FIG. 1, since the outer pairs of cam members (i.e., cam members 31, 32, 37 and 38) are longer than the inner pairs of cam members (i.e., cam members 33, 34, 35 and 36), the cam surfaces on cam members 31, 32, 37 and 38 extend outwardly from the support bar (and from the pivot rod) a distance greater than that of the cam surfaces of cam members 33, 34, 35 and 36. Therefore, it is likewise possible to firmly anchor the camming device of this invention in openings appreciably larger than that which could be spanned by the fully extended smaller cam members because of the use of the multiplicity of cam members.

In operation, anchoring of the camming device of this invention in an opening is achieved by retracting the actuator bar rearwardly (as shown in FIG. 3) so that all of the cam members are moved to a position adjacent to the support arm.

As can be appreciated from the drawings, this position of the cam members occurs since cables 52 and 53 are directly connected to the inner cam members and, upon retraction of actuator 48, the pins extending from the inner cam members engage the outer cam members to cause movement of these members, along with the inner members, to the position adjacent to the the support arm.

After insertion of the camming device into the opening (i.e., by inserting the forward end with the cam members thereon into the opening), the actuator rod is then released to allow the cam members to be urged by the springs connected therewith toward the extended position (which position is shown in FIGS. 1 and 2). If the opening is relatively small, the larger cam members (i.e., cam members 31, 32, 37 and 38) will engage the wall at the edge of the cam surfaces and will be prevented from gripping the wall. The smaller cam members (i.e., cam members 33, 34, 35 and 36), however, will still be free to pivot to a position where the cam surfaces engage the wall along an extended portion of the cam surfaces to thus firmly anchor the camming device in place (while the cam members are interrelated with respect to some movements, they are still free to move independently under the urging of the springs in the extending direction so that the smaller cam members will have cam surfaces engaging the wall even though the cam surfaces of the larger cam members cannot grip the wall).

If the opening is larger, the inserting operation is the same, and after release of the cam actuator, all of the cam members will pivot about pivot rod 29. While the smaller cam members will not engage the walls if the opening is sufficiently great, the cam surfaces of the larger cam members are still free to engage the wall and provide the needed solid anchor.

As shown in FIGS. 1 through 4, the curvature of the arcuate cam surfaces of the larger and smaller cam members are chosen such that the smaller cam members will solidly engage the walls of a smaller opening, and the larger cam members will solidly engage the walls of a larger opening, with an intermediate opening being engaged by all of the cam surfaces to thus provide an overall continuous cam surface that will engage the walls to provide a firm anchor over an extended range of sizes of wall openings.

When anchored, the device can then be utilized in a normal manner in conjunction with ropes engaging spacers 26 and/or with a rope or strap engaging spacer 27. By use of a web strap or the like engaging spacer 27, it is also possible to utilize the anchored device while at the same time changing or receiving a rope in the rope receiving spacer 26.

To remove the anchored device from the opening, it is first necessary to move actuator rod 48 rearwardly in slots 50 of support bars 24 and 25 to cause pivoting of the cam members toward the withdrawn position (as shown in FIG. 2). This frees the cam surfaces from the walls of the opening, and the device can then be retracted from the opening. In retracting the cam members to the withdrawn position, it is possible to exert greater pressure on one side than the other if necessary by putting pressure on one side of the actuator rod as may be needed to free cam members on the side that pressure is applied to the cam actuator.

An alternate embodiment 56 of the invention is shown in FIG. 5 through 10. As shown, support bar 58 is a single rod or cable having a rope receiving loop 60 at one end and a U-shaped support 62 at the other end. Actuator 64 has a central opening therein to receive support rod 58 therethrough so that the actuator can be moved forwardly and rearwardly between limits established by shoulders 65 and 66 at loop 60 and U-shaped support 62, respectively. A pair of finger engagable tabs 68 and 69 extend outwardly at the opposite sides of the actuator to facilitate moving the actuator forwardly and rearwardly, and cables 71 and 72 extend from the actuator to cam members 74 and 75 mounted on pivot pin 76 extending between the legs 77 and 78 of the U-shaped cam support 62.

Figure 5:
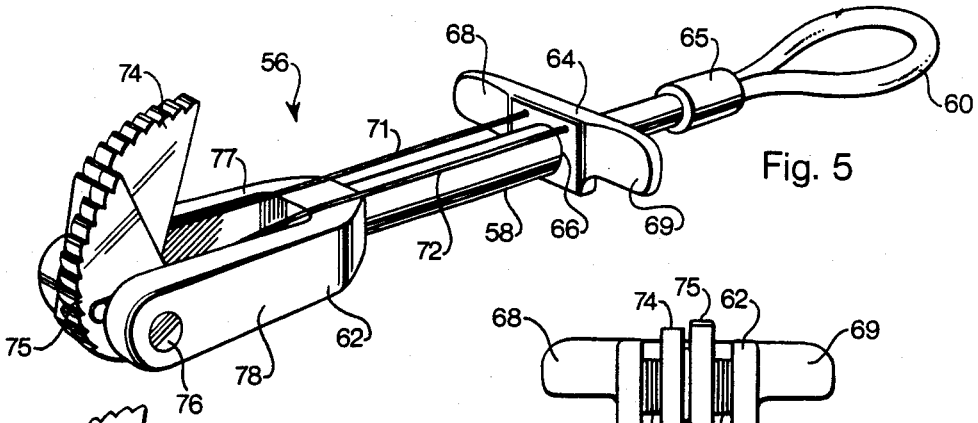
FIG. 5 is a perspective view of a second embodiment of the camming device of this invention illustrating the cam members in the fully extended position.
Figure 8:
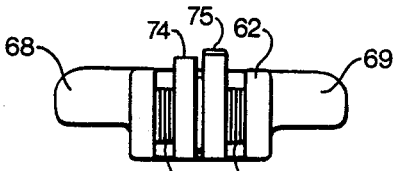
FIG. 8 is a front elevation view of the camming device shown in FIG. 7A.
Figures 6, 7B, 7C:
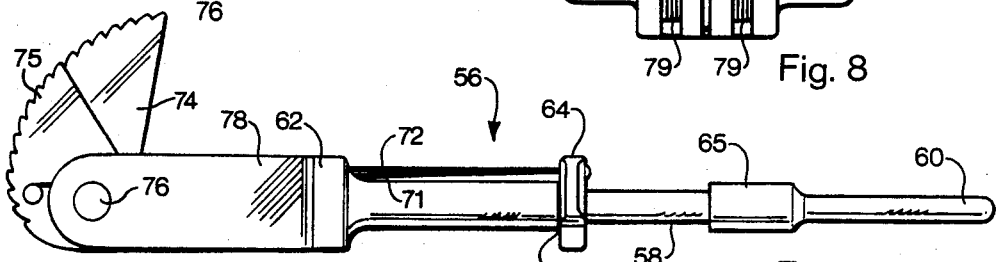
FIG. 6 is a side elevation view of the camming device shown in FIG. 5.
FIG. 7B and 7C are side elevation views of the cam members of the camming device shown in FIG. 7A, with each cam member being independently illustrated in the fully withdrawn position with respect to the support bar shown in FIG. 7A.
Figure 7A:
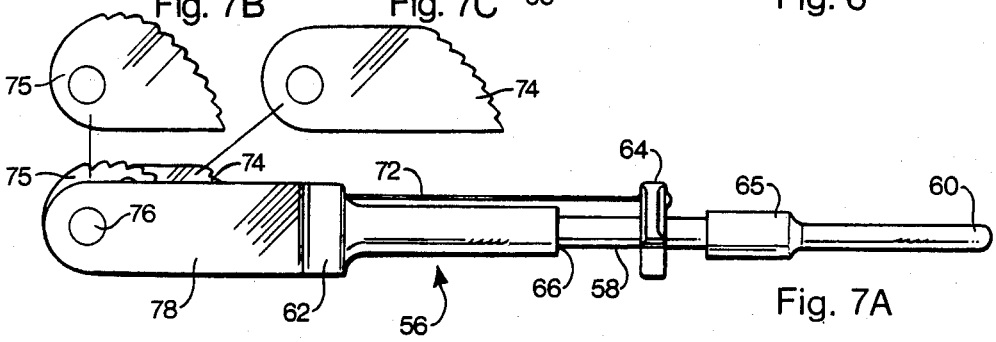
FIG. 7A is a side elevation view of the camming device shown in FIGS. 5 and 6, but illustrating the cam members in the fully withdrawn position.
Figure 9:
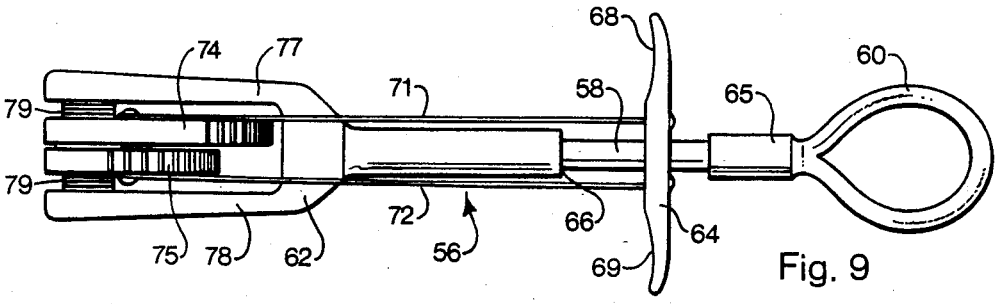
FIG. 9 is a top elevation view of the device shown in FIG. 7A.

Embodiment 56 operates in the same manner as does embodiment 20 except that only two cam members are utilized and both extend from the same side of the support arm. As shown in FIGS. 5 and 6, the two cam members provide an extended continuous arcuate surface (in the same manner as do members 31 though 38 of embodiment 20) when the cam members are moved to the extended position (as shown in FIGS. 5 and 6). By moving actuator 64 forwardly, the cam members are caused to pivot to assume the withdrawn position adjacent to the support bar in the same manner as described hereinabove with respect to embodiment 20 except that the cam members shown in FIGS. 5 through 10 are both connected to cables so that pins are not needed, with the withdrawn position being shown in FIGS. 7 through 9. When released, cam members are urged by springs 79 (see FIG. 9) toward the extended position (alternately, the cables could be replaced by rods to cause movement of the cam members in both directions) so that one or both can engage the walls of an opening to anchor the device in the same manner described hereinabove with respect to embodiment 20.

Figure 10:
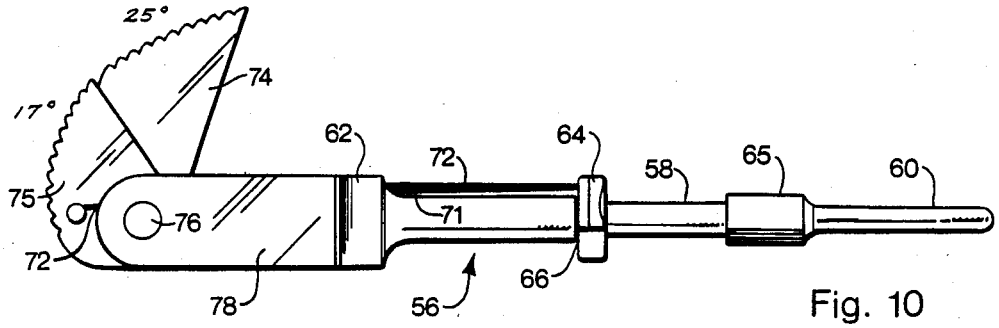
FIG. 10 is a side elevation view of the camming device shown in FIG. 5, with FIG. 10 being similar to that of FIG. 6 but particularly illustrating a cam configuration utilizing two cams of different profiles. In this example, one cam is a 17° logarithmic spiral and the other back up cam is a steeper 25° logarithmic spiral.

The arcuate cam surfaces of the cam members are chosen to provide optimum anchoring throughout the size range of opening in which the device is to be anchored. An indicated in FIG. 10, by way of example, the larger cam member can have a cam surface with a 25° angle while the smaller cam member can have a cam surface with a 17° angle to achieve a bi-angular overall continuous arcuate surface over the entire range of achievable anchoring, as indicated in FIG. 10.

Figure 11:
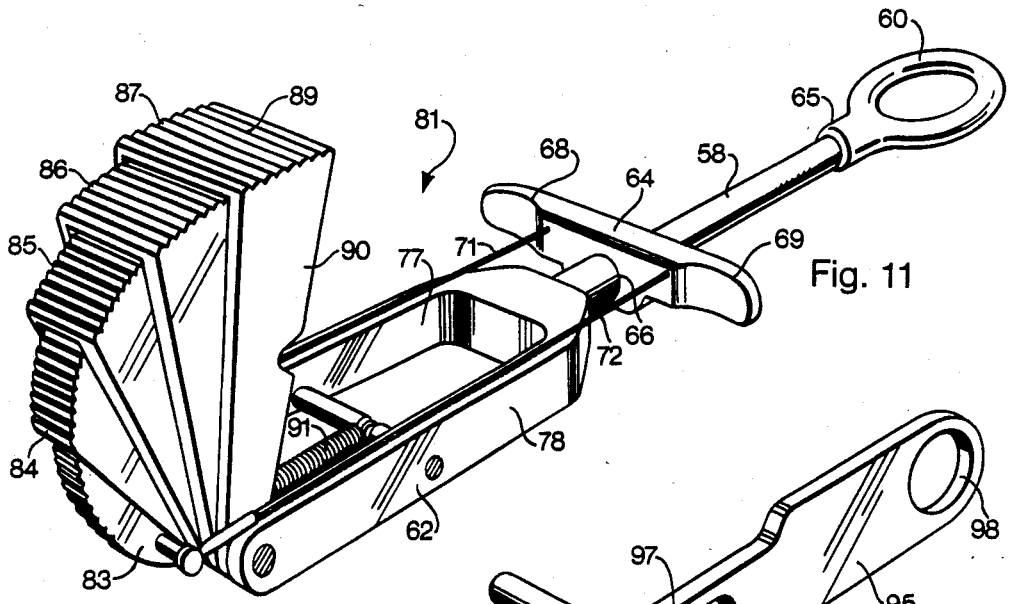
FIG. 11 is a perspective view of a third embodiment of the camming device of this invention with the cam members being illustrated in the fully extended position.

A third embodiment 81 of the camming device of this invention is shown in FIG. 11. This embodiment is similar to that of embodiment 56 shown in FIGS. 5 through 10, except that a plurality of cam members 83, 84, 85, 86 and 87 have been utilized, with each cam member having a cam surface 89 at the outer edge of a box-like support structure 90. Each of the box-like structures are chosen to be of a size such that each smaller structure is received within the larger structure as the cam members are pivoted to the withdrawn position. As shown, cables 71 and 72 are connected with cam member 83 and the cam members are biased to the extended position by spring 91. Embodiment 81 operates in the same manner as do embodiments 20 and 56, except that all five cam members are permitted to move different distances to achieve the extended position of each wherein each presents a minor portion of the overall cam surface, as indicated in FIG. 11.

Figure 12:
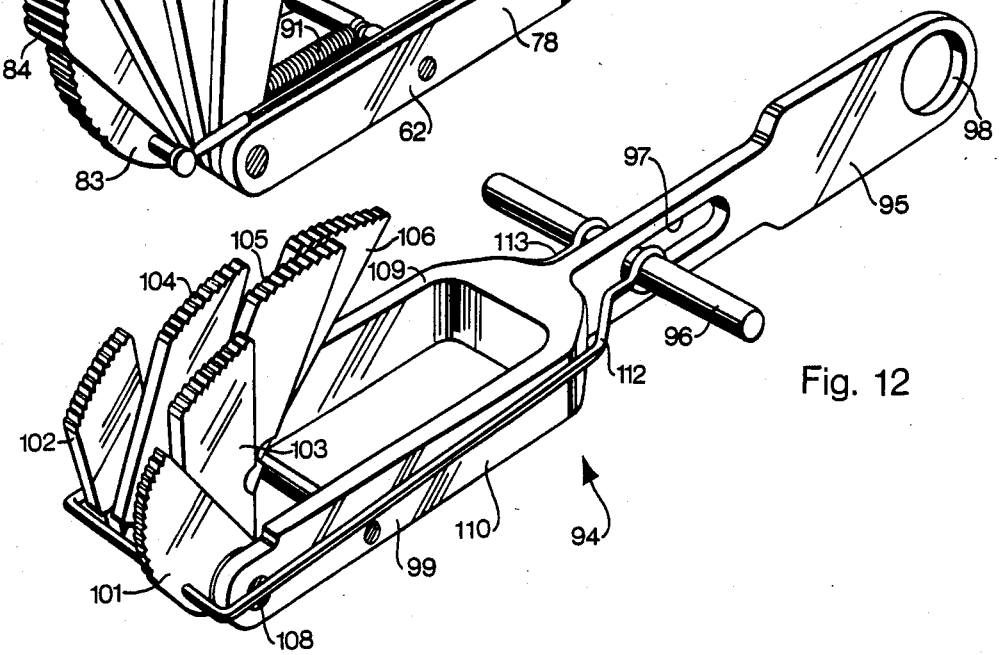
FIG. 12 is a perspective view of a fourth embodiment of the camming device of this invention with the cam members being illustrated at varying angles of extension.

A fourth embodiment 94 of the camming device of this invention is shown in FIG. 12. This embodiment is similar to the previously described embodiments in both operation and structure. A single bar 95 is utilized as the support arm and actuator 96 is received in notch 97 therein. A rope or snap link receiving aperture 98 is provided at the rear portion of bar 95 and a U-shaped portion 99 is provided at the front end of the bar. Cam members 101, 102, 103, 104, 105 and 106 are positioned spaced relative to one another along pivot pin 108, which pin extends between legs 109 and 110 of the U-shaped portion 99.

Embodiment 94, as shown in FIG. 12, utilizes stiff rods 112 and 113 to actuate cam members 101 and 102 with cam members 103, 104, 105 and 106 being moved by pins (not shown) extending along adjacent cam members to urge movement of each adjacent cam members during movement of the cam members 101 and 102 to achieve the fully extended position (as shown in FIG. 12), at which position the continuous arcuate cam surface provided by all the cams is achieved. Withdrawal is achieved by moving actuator 96 rearwardly in slot 97 to cause pivoting of cam members 101 and 102 which, in turn allows the other cam members to pivot (either by springs or pin connections therebetween).

A fifth embodiment 114 of the camming device of this invention is shown in FIG. 13 through 16. This embodiment is similar to that of embodiment 56 shown in FIGS. 5 through 10, except that three cam members 115, 116 and 117 have been utilized. Operation is the same as described hereinabove with respect to embodiment 56, except that the three cam members 115, 116 and 117 are contoured to give a constant angle continuous surface extended over all three arcuate surfaces of the cam members.

Figure 13:
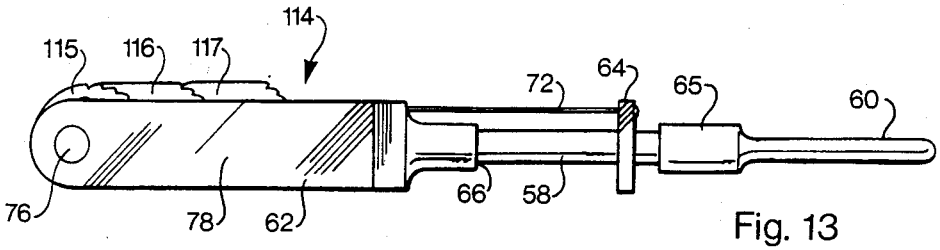
FIG. 13 is a side view of a fifth embodiment of the camming device of this invention and illustrating the cam members in the fully withdrawn position.
Figure 14:
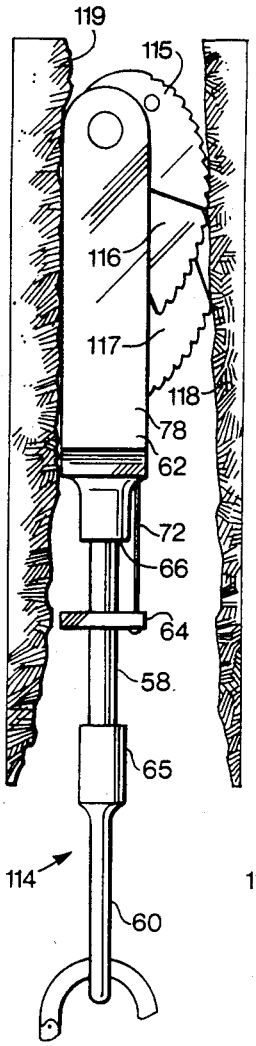
FIG. 14 is a side elevation view of the camming device shown in FIG. 13 shown firmly anchored in a narrow opening.
Figure 15:
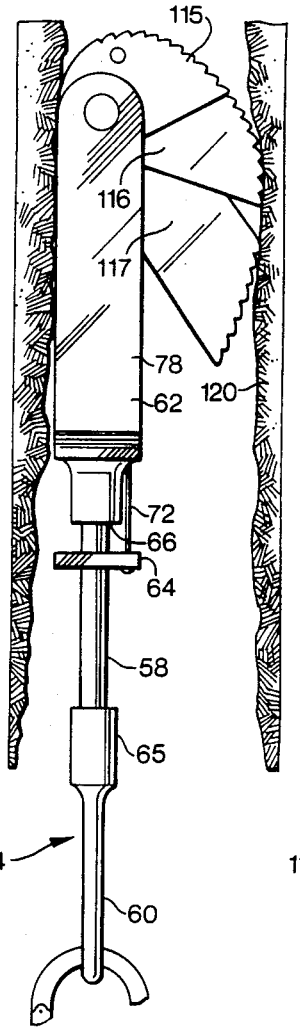
FIG. 15 is a side elevation view of the camming device shown in FIG. 13 shown firmly anchored in a medium sized opening.
Figure 16:
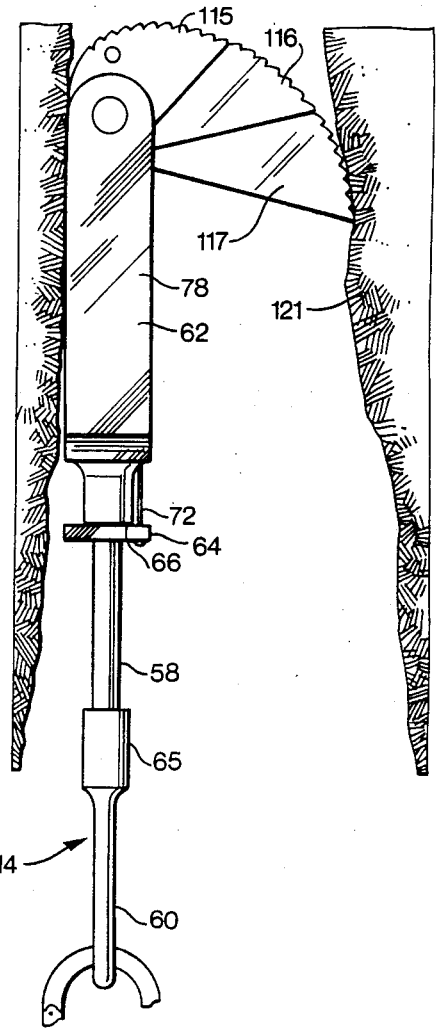
FIG. 16 is a side elevation view of the camming device shown in FIG. 13 shown firmly anchored in a wide opening.

Embodiment 114 of the device of this invention is shown in FIG. 13 in the withdrawn position, while FIGS. 14 through 16 illustrate extending of the cam members for a small opening (FIG. 14), a medium sized opening (FIGURE 15), and a larger opening (FIG. 16) to achieve firm anchoring in each opening utilizing this invention.

As shown in FIG. 14, due to the smaller size of the opening, cam surfaces 116 and 117 cannot be extended sufficiently to achieve anchoring. The smallest cam member 115 however, is free to pivot to a point where firm engagement with wall 118 of the opening is achieved (with the backside of the device resting against opposite wall 119 of the opening). As shown in FIG. 15, when the opening is sufficiently large so that cam member 115 is too small to engage wall 120, the cam surfaces of cam members 116 and 117 can, and do, engage wall 120, and both combine to provide the necessary firm anchor. FIG. 16 illustrates a still larger opening with the cam surfaces of cam member 117 being able to engage wall 121 and provide the necessary anchor.

As can be appreciated from the foregoing, this invention provides an improved camming device having a plurality of cam members to enable the device to be utilized to provide a firm anchor over a broad size range of openings without adversely affecting the ability to use the device in smaller openings.

What is claimed is:

1. A device for providing an anchor at multisized openings in a surface, said device comprising:

support means having a body portion insertable into an opening in a surface; and a plurality of cam means mounted on said body portion of said support means with each of said cam means having a cam surface that is movable between a withdrawn position adjacent to said body portion and an extended position outwardly of said body portion, and with at least one portion of one of said cam surfaces extending outwardly a distance greater than at least one portion of at least one other of said cam surfaces when said cam surfaces are at said extended position whereby said device can be utilized over an extended size range of openings in said surface.

2. The device of claim 1 wherein said support means is an elongated arm having said plurality of cams mounted at one end thereof.

3. The device of claim 1 wherein said body portion includes pivot means, and wherein said plurality of cam means are mounted for pivotal movement on said pivot means to effect movement of said cam surfaces between said withdrawn and extended positions.

4. The device of claim 3 wherein said device includes actuator means with said actuator means including first means for moving said cam surfaces toward said withdrawn position, and second means for urging said cam surfaces toward said extended position.

5. The device of claims 4 wherein said first means includes cable means, and wherein said second means includes spring means.

6. The device of claim 1 wherein said plurality of cam surfaces are offset from one another when in said extended position to provide a substantially continuous overall cam surface to thus enable said device to be utilized over said extended size range of openings.

7. The device of claim 1 wherein said cam means includes at least two cams of dissimilar size to provide said cam surface at different distances from said body portion.

8. The device of claim 7 wherein said cam means includes at least two pairs of cams of dissimilar size to provide said cam surfaces at different distances from said body portion.

9. A device for providing an anchor in different sized openings in a sloped surface to be climbed, said device comprising;

an elongated support arm having a first end insertable into said opening in said sloped surface;

a plurality of cam means having a pivot portion mounted for pivotal movement at and with respect to said first end of said support arm, with each of said cam means including an arcuate cam surface spaced from said first portion so that said cam surface is moved between a first position adjacent to the first end of said support arm and to a second position spaced outwardly from said first end of said support arm, and with at least one of said cam means having said cam surface spaced a distance from said pivot point greater than that of at least one other of said cam means whereby when at said second position at least one portion of said one cam means extends outwardly a distance greater than at least a portion of said cam surface of said second cam means whereby said overall arcuate cam surface presented by said cam means permits anchoring of said device over an extended size range of said openings in said sloped surface; and an actuator mounted on said elongated support arm to effect movement of said cam means to at least said withdrawn position.

10. The device of claim 9 wherein said support arm includes a pair of spaced members having a pivot pin extending therebetween to receive said first portion of said cam means thereon to establish a common pivot line for said cam means.

11. The device of claim 10 wherein said plurality of cam means includes at least two cams mounted side by side on said pivot pin.

12. The device of claim 11 wherein said cam surfaces of said two cams have different angles of curvature whereby a continuous bi-angular curved cam surface is presented over substantially the sum of the lengths of said cam surfaces to thereby extend the size range of openings that can be utilized for anchoring purposes.

13. The device of claim 10 wherein said plurality of cam means includes at least two pairs of cam means mounted side by side on said pivot bar.

14. The device of claim 10 wherein said plurality of cam means includes at least three cams mounted side by side on said pivot bar.

15. A device for providing an anchor in different sized openings in a severely sloped surface to be climbed, said device comprising:

an elongated support means having spaced arms at at least one end portion;

a pivot pin extending between said spaced arms of said support means at said one end portion thereof;

a plurality of cam means each of which has a pivot portion mounted on said pivot pin at spaced positions therealong with respect to one another, and each of which has an arcuate cam surface with at least a first one of said cam surfaces extending outwardly from said pivot pin a distance less than that of at least a second one of said cam members;

pin means mounted on said first one of said cam means to cause actuation of said second one of said cam means in a direction causing said cam surfaces to be moved to the withdrawn position adjacent to said support arm;

an actuator mounted on said support means at a point spaced from said cam means;

cable means connected between said actuator and said one of said cam means whereby actuation of said actuator in one predetermined direction causes said cam surfaces to be moved to said withdrawn position; and spring means connected with said cam means to cause said cam means to be urged away from said withdrawn position to an extended position whereby said cam surfaces are successively brought toward the wall of an opening so that at least one of said cam surfaces is brought into engagement with said wall to provide an anchor thereat over the full range afforded by said cam surfaces of said plurality of cam means.

16. The device of claim 15 wherein said support means includes a receiving means for receiving a rope used in climbing.

17. The device of claim 16 wherein said support means also includes a strap receiving means for enabling use of said device when in place with and without said rope.

18. The device of claim 15 wherein said cam surfaces have different angles of curvature to facilitate anchoring of said device.

19. The device of claim 15 wherein said cam means include at least three cams mounted on said pivot pin with said cam surfaces of each of said cams having a different radius of curvature and a different pivot radius.

* * * * *